United States Patent [19]

Eckerud

[11] Patent Number: 4,835,931

[45] Date of Patent: Jun. 6, 1989

[54] ARRANGEMENT FOR A WALL

[75] Inventor: Ove Eckerud, Linköping, Sweden

[73] Assignee: Conforex AB, Linkoping, Sweden

[21] Appl. No.: 199,264

[22] PCT Filed: Dec. 10, 1986

[86] PCT No.: PCT/SE86/00564

§ 371 Date: May 25, 1988

§ 102(e) Date: May 25, 1988

[87] PCT Pub. No.: WO87/03635

PCT Pub. Date: Jun. 18, 1987

[30] Foreign Application Priority Data

Dec. 11, 1985 [SE] Sweden ..... 8505862

[51] Int. Cl.[4] ..... E04B 2/82

[52] U.S. Cl. ..... 52/586; 52/311; 52/459; 403/292; 403/405.1

[58] Field of Search ..... 52/233, 311, 459, 582, 52/585, 586; 403/292, 405.1

[56] References Cited

U.S. PATENT DOCUMENTS 3,364,641 1/1968 Brenneman ..... 52/586 X
3,386,221 6/1968 Giovannucci .
4,031,675 6/1977 Roberts et al. .

FOREIGN PATENT DOCUMENTS 0026936 4/1981 European Pat. Off. .
3123342 1/1983 Fed. Rep. of Germany .
845155 of 1939 France ..... 52/459
408362 of 1964 Switzerland ..... 52/585
587997 of 1975 Switzerland ..... 52/585

*Primary Examiner*—John E. Murtagh
*Assistant Examiner*—Jerrold D. Johnson
*Attorney, Agent, or Firm*—Albert L. Jeffers; Lawrence A. Steward

[57] ABSTRACT

An arrangement for a wall, for example, for dividing up a room or for constructing an exhibition stand or a reception kiosk, etc. The arrangement comprises a number of preferably individually executed, mutually interchangeable panel sheets. These are so arranged as to be secured by means of connecting elements designed to engage on the opposing edges of adjacent panel sheets. Characteristic features of the invention are that the panel sheets are executed along at least two opposing edges with longitudinal channels, and that the aforementioned connecting elements, which are at least two in number on the edge of each panel sheet, are so arranged as to connect the panel sheets with a space relative to one another and are executed with internal opposing grooves. When the connecting elements are installed between the two panel sheets, the grooves will coincide with the channels, so that a strip-shaped decorative element can be inserted in the channels and the grooves and can occupy said space.

3 Claims, 3 Drawing Sheets

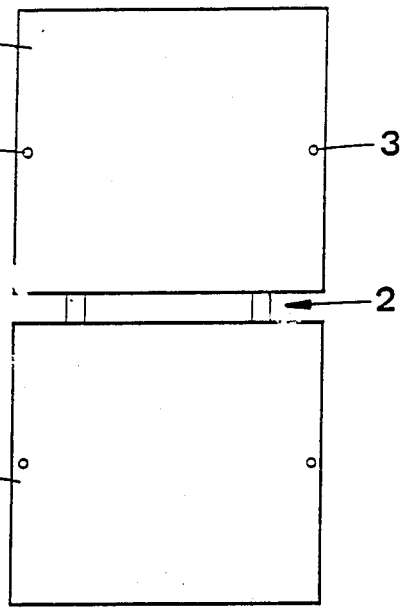
FIG 1
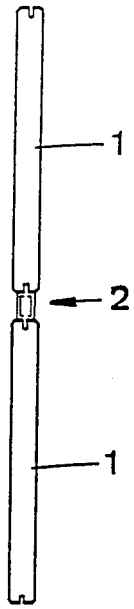
FIG 2
FIG 3
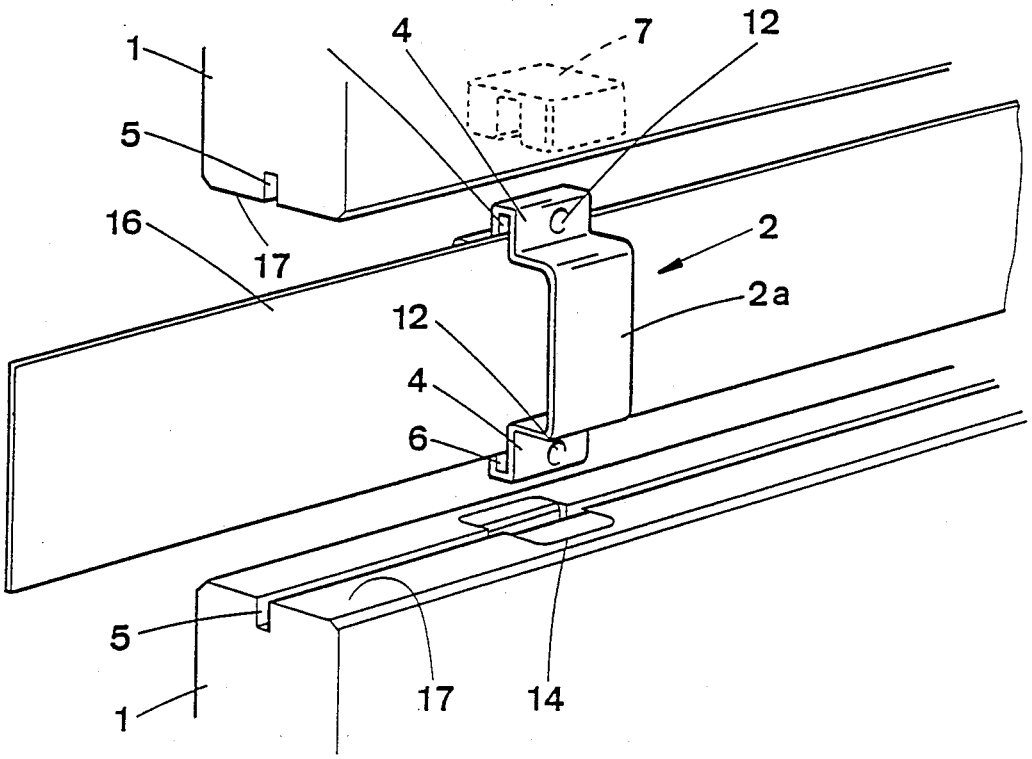

ARRANGEMENT FOR A WALL

The present invention relates to an arrangement for a wall, for example for dividing up a room or for constructing an exhibition stand or a reception kiosk, etc., comprising a number of preferably individually executed, mutually interchangeable panel sheets, which are so arranged as to be secured to one another by means of connecting elements designed to engage on the opposing edges of adjacent panel sheets.

Arrangements for securing panel sheets to one another are previously disclosed through, for example, U.S. Pat. Nos. 3,386,221 and 4,031,675. A common feature of such previously disclosed arrangements is that an effort has been made to secure the wall elements or parts thereof in the form of panel sheets edge to edge adjacent to one another in such a way that the smallest possible slots are formed between the wall elements or the panel sheets. A method of securing of this kind may well produce a harmonious visual impression of the finished wall, although it can also generate a characterless and nondescript effect, especially if it constitutes part of an exhibition stand or reception kiosk.

The object of the present invention is to make available an arrangement of the kind referred to by way of introduction, by means of which a wall constructed in accordance with the invention is given an original and distinctive appearance, which is made possible in that the panel sheets are executed along at least two opposing edges with longitudinal channels, and in that the aforementioned connecting elements, which are at least two in number on the edge of each panel sheet, are so arranged as to connect the panel sheets with a space relative to one another and are executed with internal opposing grooves, which, when the connecting elements are installed between the two panel sheets, coincide with the channels, so that a strip-shaped decorative element can be inserted in the channels and can occupy said space.

By causing the panel sheets and the strip-shaped decorative elements to carry the colours of a company, the exhibition stand or the kiosk are capable, in conjunction with an in other respects individually specified design, of conveying to the visitors to an exhibition, for example, a visual impression associated with the company and its products. The company's trade marks or advertising messages can also be printed on the decorative element.

Figure 4:
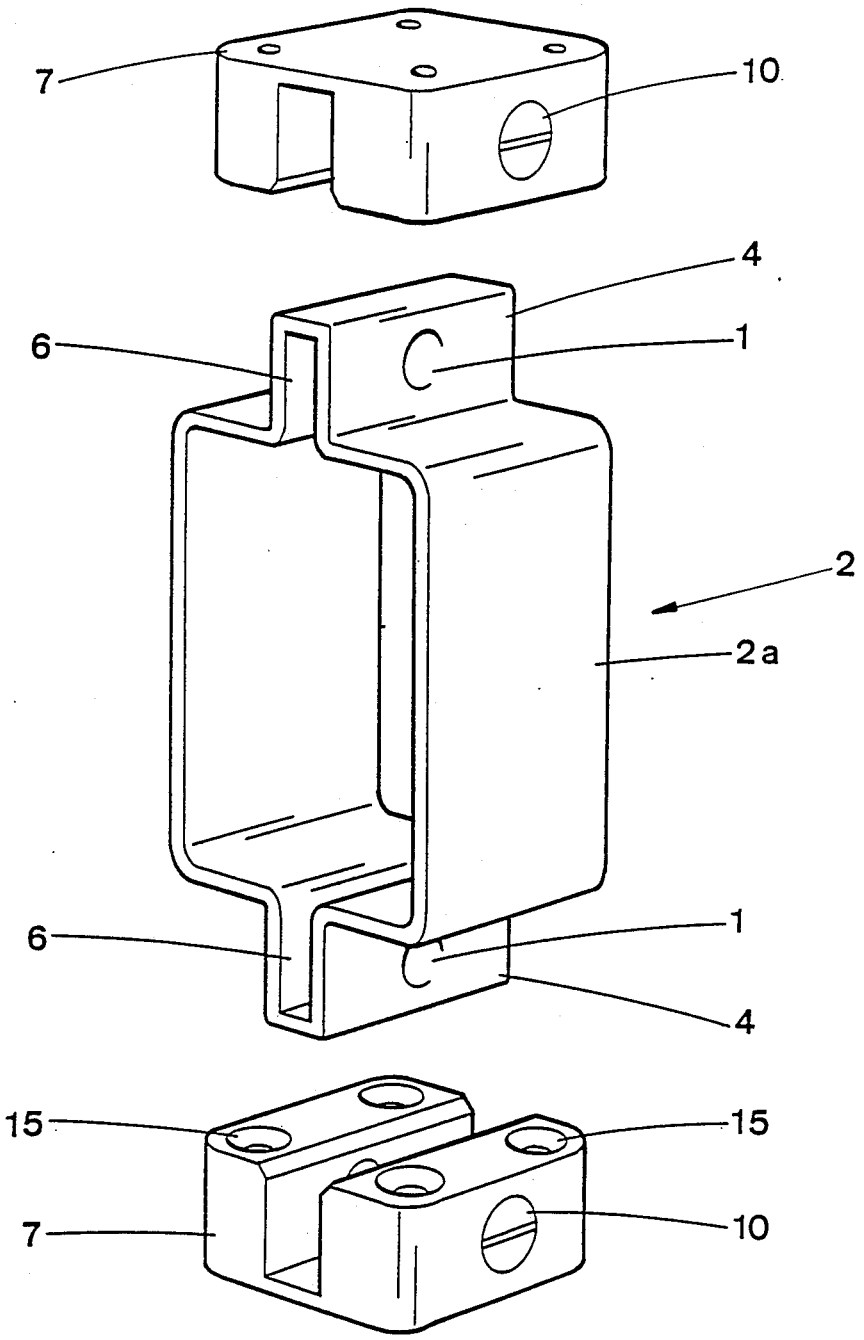
Figure 5:
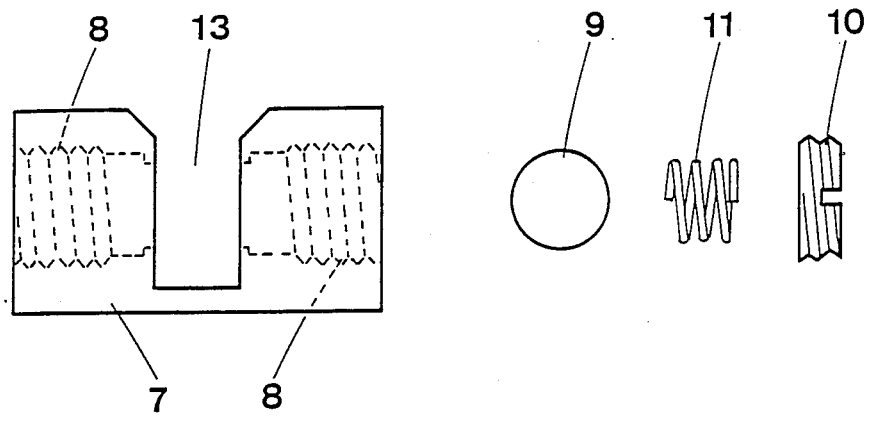

Preferred detailed designs for the arrangement in accordance with the invention are evident from the accompanying subordinate Patent claims and from the drawing, in which FIG. 1 illustrates as a plan view from the front two panel sheets arranged one next to the other in accordance with the invention. FIG. 2 illustrates as a plan view from the side the sheets in FIG. 1. FIG. 3 illustrates in perspective the manner in which the installation by means of the arrangement in accordance with the present invention takes place. FIG. 4 illustrates the connecting elements and the holder in accordance with the inv[illegible]ion in perspective view. FIG. 5 illustrates the c[illegible] parts of the holder in plan view.

The designation 1 is [illegible]e drawings in respect of two panel sheets designe[illegible] be included in a wall for dividing up a room or for constructing an exhibition stand, for example. The panel sheets are individually mutually interchangeable and are preferably of different designs so as to form different parts of the wall or the exhibition stand. The wall panel sheets, for example, may thus be plane and opaque, whereas those which are intended for parts of a sign or for the ceiling may exhibit the form of parts of cylindrical or cupolated surfaces.

The panel sheets 1 are so arranged as to be secured to one another by means of connecting elements 2,3 designed to engage on the opposing edges 17 of adjacent panel sheets 1.

In the design illustrated in the drawing the connecting elements 3, the purpose of which is to connect the panel sheets to one another, are of a conventional kind, that is to say the connection is executed in such a way that the smallest possible slots are formed in the joint between two panel sheets. However, there is nothing to prevent the connecting elements 3 also from being of the kind in accordance with the invention, as described below.

In accordance with the invention the panel sheets are executed with longitudinal channels 5 along at least two opposing edges 17, these being the horizontal edges in the design illustrated. The connecting elements 2, which are at least two in number on the edge 17 of each panel sheet 1, are so arranged as to connect the panel sheets 1 with spaces 18 relative to one another. For this purpose the connecting elements 2 are executed with an annular spacer component and two opposing flange components 4, the latter being so executed as to form an internal groove 6.

In order to permit the flanges 6 of the connecting elements 2 to be attached securely to the edges 17 of the respective panel sheets, the latter are provided with holes 14 for U-shaped devices 7. The side parts of such a device 7 are provided with a threaded hole 8, in which there is installed a spherical component 9, which, under the effect of a spring 11 retained by a screw 10, is so arranged as to be pressed into cavities 12 in the sides of the flanges 4, when these are pressed into grooves 13 in the aforementioned U-shaped devices 7. For the purpose of securing these in the holes 14, the U-shaped devices 7 are executed with preferably threaded holes 15, by means of which brackets and similar, for example, can be secured, for the purpose of installing a sheet or similar to serve as a counter-top.

In accordance with the invention the grooves 6 coincide with the channels in the panel sheets 1 when the connecting elements 2 are installed between two panel sheets, which makes it possible to insert a strip-shaped decorative element 16 in the channels 5 and the grooves 6 and thus to occupy the space 18 between the panel sheets 1. The decorative elements 16 may, as mentioned by way of introduction, exhibit a colour and a structure which are different from those of the panel sheets and may, if considered appropriate, be provided with printed text or company symbols.

Clearly, the distance pieces 2*a* of the connecting elements 2 may be designed in a manner other than that illustrated in the drawing and described above, for example in the form of a circular ring, and may be of a colour other than that of the panel elements 1 and/or the decorative element.

I claim:

1. A wall arrangement comprising:

a plurality of panel sheets, each panel sheet including an edge having a longitudinal channel formed therein;

means, disposed intermediately and engaging respective edges of adjacently arranged panel sheets, for securing said panel sheets one to another in spaced relationship to define a space therebetween, said means comprising at least two connecting elements including internal opposing grooves disposed within said channels, whereby when said connecting elements are installed intermediate two panel sheets a strip-shaped decorative element is capable of being inserted in the said channels and said corresponding grooves, thereby occupying said space.

2. The wall arrangement of claim 1 and further comprising:

holding means incorporated within each said panel sheet edge for securing a respective connecting element thereto, said connecting element comprising a rectangular ring including two opposing projecting flange members engaged by respective holding means associated with said adjacently arranged panel sheets.

3. The wall arrangement of claim 2 in which:

said holding means comprises a U-shaped holding element having a bottom portion and a pair of upwardly extending side portions, each side portion including an inwardly opening hole in which is installed a spherical member acted upon by a spring disposed within said hole to urge said spherical member outwardly from said hole, each said flange member including a cavity corresponding to a respective spherical member into which said respective spherical member is partially received, whereby said flange member is received and retained generally within said channel.

* * * * *